US006364703B1

(12) United States Patent
Ito

(10) Patent No.: US 6,364,703 B1
(45) Date of Patent: Apr. 2, 2002

(54) WATER-PROOF STRUCTURE FOR CONNECTOR WITH CABLE SEAL

(75) Inventor: Osamu Ito, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/523,596

(22) Filed: Mar. 10, 2000

(30) Foreign Application Priority Data

Mar. 11, 1999 (JP) ..... 11-065491

(51) Int. Cl.[7] ..... H01R 13/40
(52) U.S. Cl. ..... 439/589; 439/598
(58) Field of Search ..... 439/587, 589, 439/274, 275, 598

(56) References Cited

U.S. PATENT DOCUMENTS

| | | | | |
|---|---|---|---|---|
| 4,310,211 A | * | 1/1982 | Bunnell et al. | 439/358 |
| 4,690,478 A | * | 9/1987 | Rahrig et al. | 439/587 |
| 5,066,242 A | * | 11/1991 | Martucci | 439/587 |
| 5,437,563 A | | 8/1995 | Kihira et al. | |
| 5,588,856 A | * | 12/1996 | Collins et al. | 439/589 |
| 5,810,616 A | | 9/1998 | Ivey | |
| 5,820,404 A | | 10/1998 | Chishima et al. | |
| 5,830,004 A | | 11/1998 | Abe | |

FOREIGN PATENT DOCUMENTS

| | | | |
|---|---|---|---|
| EP | 0420010 | | 4/1991 |
| EP | 0791985 | | 8/1997 |
| JP | 4-49480 | | 2/1992 |
| JP | 7-240250 | * | 9/1995 |

* cited by examiner

*Primary Examiner*—Neil Abrams
(74) *Attorney, Agent, or Firm*—Greenblum & Bernstein, P.L.C.

(57) ABSTRACT

To achieve the sealability of a connector in a favorable condition, at the rear end of an inner casing 10 provided therein with a press-connecting female terminal which is press-connected with cable, an elastic plug is mounted, and an inner casing and the elastic plug are housed in a housing area of an outer casing. The elastic plug is housed in an elastically compressed condition on an inner peripheral side of a tubular portion, and the tubular portion is deformed outwardly by its elastic force. A pressing member provided with a control piece is mounted on the rear end of the tubular portion. Because the control piece is pressed down by sandwiching from the outer peripheral side of the upper wall and lower wall of the tubular portion, the outwardly deformed portions of the tubular portion are controlled and can return to nearly their original shape.

2 Claims, 5 Drawing Sheets

WATER-PROOF STRUCTURE FOR CONNECTOR WITH CABLE SEAL

BACKGROUND OF THE INVENTION

1. Field of the Invention

The present invention relates to a waterproof structure for connectors. At the rear end of an inner casing provided therein with a press-connected female terminal which is press-connected with a cable, an elastic plug is mounted. The inner casing and the elastic plug are housed in a housing area of an outer casing.

2. Description of Background Information

As a connector which calls for water-proofness, a connector as set forth in Japanese Unexamined Utility Model Publication No. (Hei) 4-49480 has conventionally been known. This connector is constructed in such a manner that an inner casing which houses a plurality of metal terminals in parallel is housed an outer casing. At the rear end of the outer casing, a tubular portion is protrusively provided, into which an integrated-type rubber plug is housed which integrally seals a space between each metal terminal in the inner casing and the connected cable.

The rubber plug is housed in an elastically compressed condition on an inner peripheral side of a tubular portion, and the tubular portion is deformed outwardly by the elastic force of the rubber plug. A pressing member provided with a control piece is mounted on the rear end of the tubular portion. In this way, the tubular portion becomes horizontal (i.e. horizontally length-wise) where an integrated-type rubber plug is used and metal terminals and a plurality of metal terminals are housed in parallel. However, where a size in a transverse direction of tubular portion becomes larger, the strength at the central area becomes weaker compared with that of the ends. Also, the tubular portion is subjected to outward deformation due to the elastic force of a rubber plug when the rubber plug is pushed within the tubular portion area, which may result in a decrease in sealability. With such a type of connector which insertably mounts the integrated-type rubber plug inserted within the tubular portion area, there has not been any means to provide a supporting pillar inside for increasing the strength of tubular portion, nor any effective measures taken.

SUMMARY OF THE INVENTION

The present invention has been completed in the light of the above circumstances, with the objective to maintain water-proofness of connector at a favorable condition.

As a means for achieving the above-mentioned objective, in accordance with the present invention, at the rear end of a connector housing having at least one cavity capable of housing a metal terminal mounted on the end of a cable, a tubular portion is provided which communicates with the cavity. A water-proof elastic plug is mounted in a tight fitting manner within an inner peripheral side of the tubular portion of the connector. A pressing member, which prevents inadvertent removal of the elastic plug, is mounted on the tubular portion, and a control piece, which presses against an outer peripheral surface of the tubular portion, is formed on the pressing member in order to control an outward deformation accompanied by insertion of the elastic plug into an area defined by the tubular portion.

According to another aspect of the present invention, an inside control area which is press-fitted into the area defined by the tubular portion is provided on the pressing member. Additionally, the inside control area may be configured to have an outwardly projecting configuration that closely fits within the area defined by the tubular portion to thereby prevent inward deformation of the tubular portion.

In another aspect of the present invention, the tubular portion includes a pair of end walls and a pair of side walls, the side walls being longer in lateral dimension than the end walls, and the at least one control piece presses against an outer surface of one of the side walls. Additionally, at least a pair of control pieces may be provided, with each pair of the control pieces pressing against a respective one of the side walls.

According to another aspect of the present invention, a waterproof connector is provided that includes an outer casing including a hood area, a generally tubular hollow portion extending within the hood area, and a generally tubular portion surrounding one end of the hollow portion and extending outwardly therefrom. The connector has an inner casing insertable within an area defined by the tubular portion and within the hollow area, the inner casing including at least one cavity that is capable of receiving a metal terminal mounted on an end of a cable. An elastic plug is positioned on one end of the inner casing and insertable within the area defined by the tubular portion, and a pressing member is mountable on an outer end of the tubular portion, the pressing member including at least one control piece configured to press against an outer peripheral surface of the tubular portion to control outward deformation thereof resulting from insertion of the elastic plug within the area defined by the tubular portion.

The elastic plug may have a configuration having an outer periphery that corresponds with and tightly engages an inner peripheral surface of the tubular portion to form a waterproof seal therewith, and the pressing member may be provided with an inside control area configured to fit within an area defined by the tubular portion.

In another aspect of the present invention, the inside control area may be configured to have an outwardly projecting configuration that closely fits within the tubular portion to thereby prevent inward deformation of the tubular portion. Furthermore, the tubular portion may include a pair of end walls and a pair of side walls, the side walls being longer in lateral dimension than the end walls, and the at least one control piece presses against an outer surface of one of the side walls.

According to a further aspect of the present invention, the pressing member may have a configuration with an outer periphery sized to correspond with, and overlie, the outer end of the tubular portion, and wherein the inside control area may be configured to have an outwardly projecting configuration that closely fits within the area defined by the tubular portion to thereby prevent inward deformation of the tubular portion.

In another aspect, each the control piece is provided with an engagement groove, each engagement groove is configured to engage a respective lock tab provided on the outer peripheral surface of the tubular portion. Additionally, the inner casing may be provided with at least one protrusion, and the hollow portion of the connector includes at least one elastically deformable lock piece, such that upon complete insertion of the inner casing within the hollow portion, the deformable lock piece engages with the protrusion to thereby prevent inadvertent detachment thereof.

In a still further aspect of the present invention, a waterproof structure for a connector is provided, where the connector has an outer casing and a generally tubular portion extending outwardly therefrom, and the connector includes an inner casing insertable within an area defined by the tubular portion, the inner casing including at least one cavity that is capable of receiving a metal terminal mounted on an end of a cable. An elastic plug is positioned on one end of the inner casing and insertable within the area defined by the tubular portion to tightly interfit with the inner periphery of the tubular portion to provide a waterproof connection.

The waterproof structure includes a pressing member mountable on an outer end of the tubular portion, the pressing member includes at least one control piece configured to press against an outer peripheral surface of the tubular portion to control outward deformation thereof resulting from insertion of the elastic plug within the area defined by the tubular portion.

In another aspect, the pressing member may be provided with an inside control area configured to fit within an area defined by the tubular portion. Furthermore, the inside control area may be configured to have an outwardly projecting configuration that closely fits within the tubular portion to thereby prevent inward deformation of the tubular portion. Also, the tubular portion may include a pair of end walls and a pair of side walls, the side walls being longer in lateral dimension than the end walls, and the at least one control piece presses against an outer surface of one of the side walls.

In further aspects of the present invention, the pressing member may have a configuration with an outer periphery sized to correspond with, and overlie, the outer end of the tubular portion, and wherein the inside control area may be configured to have an outwardly projecting configuration that closely fits within the area defined by the tubular portion to thereby prevent inward deformation of the tubular portion. Additionally, each control piece may be provided with an engagement groove, with each the engagement groove configured to engage a respective lock tab provided on the outer peripheral surface of the tubular portion.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several view of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
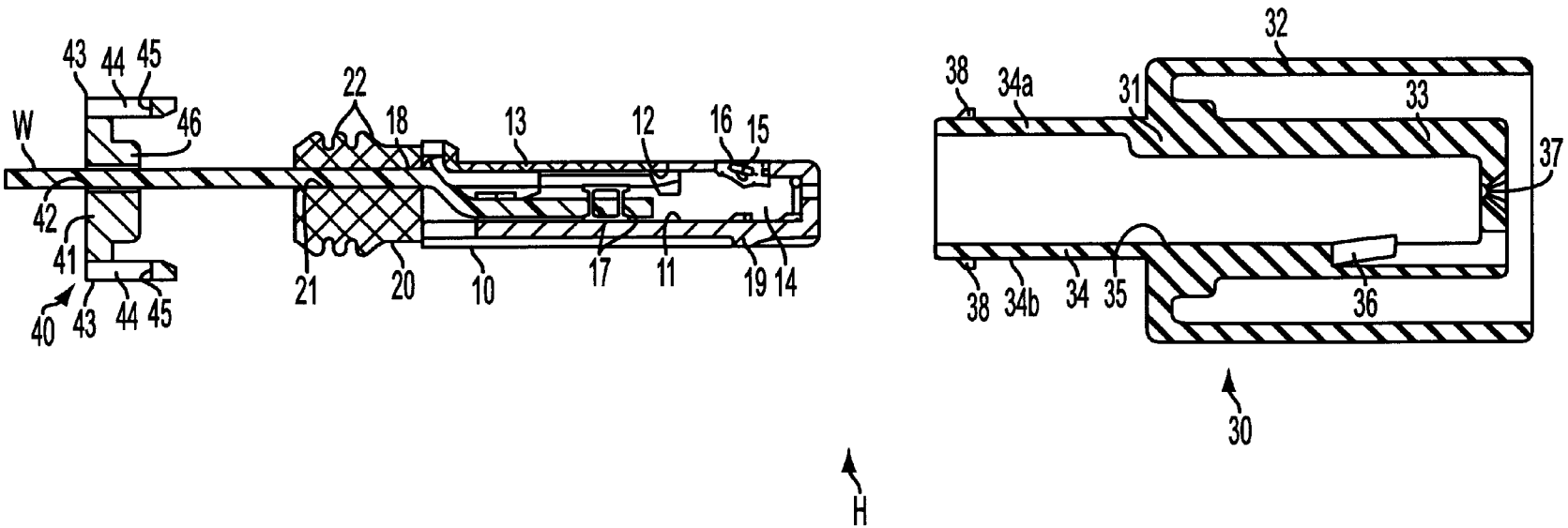
FIG. 1 is an exploded sectional view showing a waterproof connector according to one embodiment of the present invention.
Figure 2:
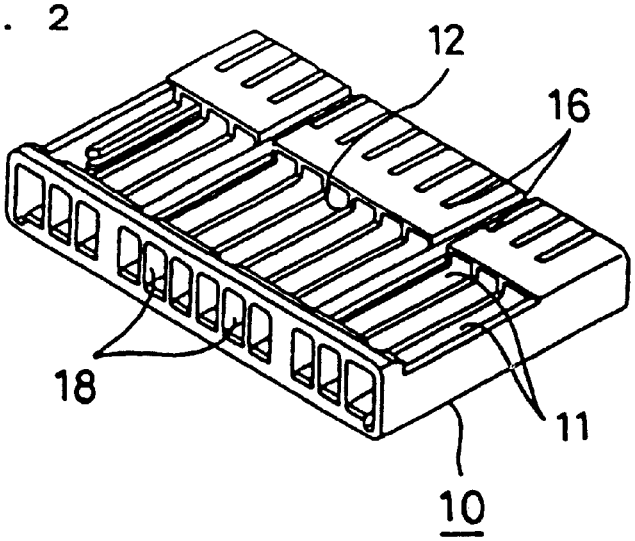
FIG. 2 is a perspective view showing an inner casing.
Figure 3:
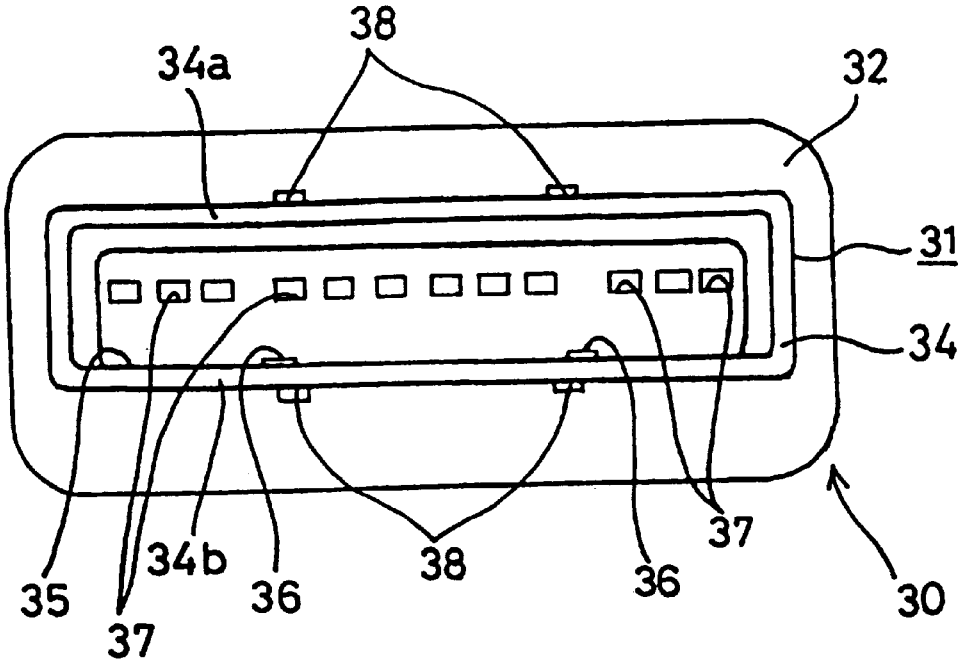
FIG. 3 is a rear elevational view showing an outer casing.

Description follows of one embodiment of the present invention with reference to FIGS. 1–7 of the drawings. The water-proof connector includes a connector housing H which houses an inner casing 10 which is provided with a water-proof elastic plug 20 inside an outer casing 30 as shown in FIGS. 1 and 3. A pressing member 40 for the elastic plug 20 is inserted within the rear end of outer casing 30. The elastic plug 20 may be formed from any suitable elastic material, such as rubber or any other suitable elastomeric material.

The inner casing 10, as shown in FIG. 1 and FIG. 2, is configured to have a long and narrow, generally box shape in a horizontally transverse direction, inside of which a plurality of cavities 11 are provided in line in the horizontally transverse direction. The cavities 11 as shown include a total number of twelve sections, six sections at the central area of the inner casing 10 and three sections spaced at slight intervals on both sides of the central area. The upper surface of inner casing 10 includes an open area 12, which exposes all of the cavities 11. Through this open area 12, press-connected female terminals 14, which permit cable W to be press-connected in each of cavity 11, are respectively housed, and a cover 13 is mounted in the opening 12 (FIG. 1). Furthermore, each cable W to be press-connected is inserted into the inner casing 10 after passing through the pressing member 40 and the elastic plug 20.

Protection of press-connected female terminals 14 from inadvertent removal from cavity 11 is achieved by forming a press-connected female terminal 14 in near-box shape, which is also allowed to connect with a corresponding male terminal to be inserted from the front side, and by an elastically mounted cantilever lance 15. The lance 15 is mounted on the upper surface of the tip of each female terminal 14, and is capable of deforming upwardly to engage a stop hole 16 provided on a cell area of each cavity 11.

A pair of press-connecting blades, disposed fore and aft, are arranged at the central part of both side walls of the press-connecting female terminal 14 by cutting upwards to the inner side, which makes it possible to perform press-connecting with cables in the press-connected female terminals 14 housed in the cavity 11.

On the rear surface of the inner casing 10, passing holes 18 are openly provided in a manner arranged adjacent each cavity 11 for allowing cables to pass through, and on the backside, a water-proof elastic plug 20 is provided with insertion holes 21 which communicate with the passing holes 18. The elastic plug 20 is held in such a manner that it sealingly contacts the rear surface of the inner casing 10, with each cable W being passed through an insertion hole 21 with a friction sealing engagement. The elastic plug 20 has a generally parallelepiped shape formed in a long and thin shape in a transverse direction. The elastic plug 20 includes lips 22 formed by three lines of swelling along the entire outer peripheral surface of the elastic plug 20. The inner casing 10 is disposed to press-fit into a tubular portion 34 of the outer casing 30 when housed in the outer casing 30. In addition, the elastic plug 20 is configured to tightly contact and provide a water-tight fit with the circumference of each cable W which is passed through an insertion hole 21.

An outer casing 30 is, as shown in FIG. 1 and FIG. 3, formed with a hollow portion 31 which allows an inner casing 10 and an elastic plug 20 to be housed, and a hood area 32 which protrudes in front from the outer peripheral surface. The hood area 32 is formed to cover the circumference of the front area 33 of the hollow portion 31, and a male-side connector (not shown) is disposed to be press-fit from the front in the space between the hollow portion 31 and the hood area 32. In this case, the tubular portion 34 which provides an inlet of inner casing 10 is provided at the rear of hollow portion 31, with respect to the hood area 32.

Figure 7:
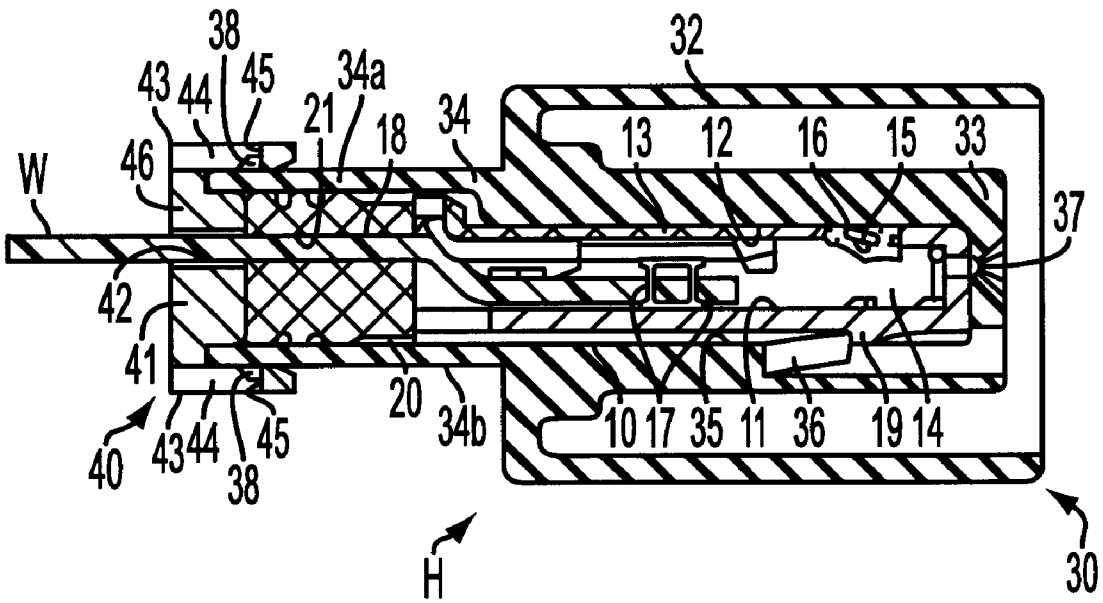
FIG. 7 is a sectional view showing a condition in which a tubular portion is pressed downwardly by a control piece.

In the hollow portion 31, the tubular portion 34 is open at the rear, forming a space which communicates with the front area 33, and this space provides a housing area 35 which allows the inner casing 10 equipped with the elastic plug 20 to be housed therein. In the housing area 35 in the front area 33 side, two unitary lock pieces 36 are respectively provided at the bottom in an elastically deformable manner, with which a protrusion 19 provided on the lower surface of the inner casing 10 is engaged (FIGS. 1 and 7). Protection of the inner casing from inadvertent detachment is achieved by this manner.

In addition, the front surface of the housing area 35 forms a wall surface of a front stop area of the inner casing 10, and includes an opening 37 into which a corresponding male terminal of the opposite connector portion is allowed to enter.

The tubular portion 34 is formed to have a generally parallelepiped shape formed in a long and narrow shape in a transverse direction. On the inner periphery of the tubular portion, the elastic plug 20 disposed at the rear of inner casing 10 is insertably mounted and elastically deforms to a compressed condition, thereby fulfilling the function of water-proofing the inside of the housing area 35. In addition, lock tabs 38 are provided on the outer periphery of upper wall 34*a* and lower wall 34*b* of the tubular portion 34. The lock tabs 38, which form a fixing mechanism for the pressing member 40, the detailed description of which follows below, are respectively mounted at positions on the upper and lower sides as shown in FIG. 3.

Figure 4:
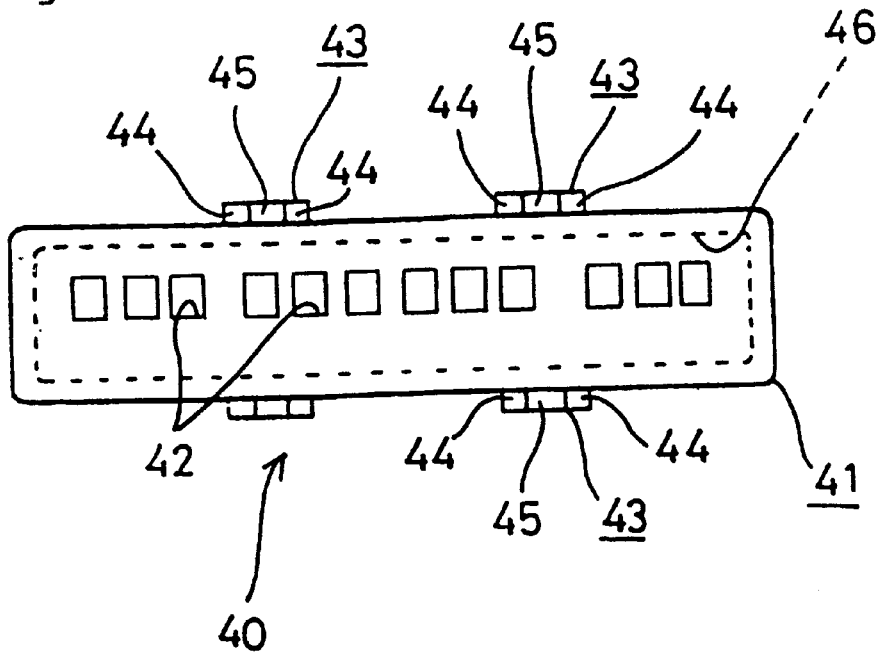
FIG. 4 is a rear elevational view showing a pressing member.

The pressing member 40 functions to prevent the elastic plug 20 from inadvertent separation from the tubular portion 34 with rear end surface of the tubular portion 34 being covered. The pressing member 40 includes a plate-type main body 41 formed to have generally the same size and shape as hollow portion 31, as shown in FIG. 1 and FIG. 4. On the main body 41, rectangular window openings 42, which allow cables W to be inserted, are respectively provided at positions in the main body 41 to correspond with the insertion holes 21 of elastic plug 20 (see FIG. 6).

On the outer periphery of each longitudinal side of the main area 41, two sets of control pieces 43, which extend directly toward the front, are provided at upper and lower positions from two points spaced a distance apart in the central area. These control pieces 43 perform a pressing function over the outer periphery of tubular portion 34, and also function as fixing devices for the pressing member 40 with the outer casing 30. In particular, the distance between the upper and lower control pieces 43 is made equal to the distance between the outer peripheral surfaces of the longitudinal portions of the tubular portion 34, making the mounting possible to cover the tubular portion 34 from its outer peripheral side, and to thereby controlling the outward deformation of the tubular portion 34. In addition, the construction of the control piece 43 is such that two extending pieces 44 protrude from a base forwardly a predetermined distance, and the front ends of each pair of pieces 44 are connected. The lock tab 38 of the above-mentioned tubular portion 34 is thus engageable with an engagement groove 45 formed between each pair extending pieces 44, thereby making it possible to fasten the pressing member 40 to the outer casing 30.

Furthermore, on the front surface of the main body 41, an inside control member 46 is formed to protrude and to have a size that allows press-fitting into the inner periphery of the tubular portion 34. When the inside control member 46 is press-fitted into the tubular portion 34, the upper wall 34*a* and lower wall 34*b* of the tubular portion 34 are supported, so that inward deformation can be controlled.

The construction of the preferred embodiment of the present invention is as described above, and the description of the effects follows below. A connector housing H is formed by mounting an elastic plug 20 onto the rear of the inner casing 30. Then, the inner casing 10, having press-connected female terminals 14 to which cables W are press-connected are provided inside the cavities 11, is inserted into the housing area 35 from the rear of the outer casing 30.

Figure 5:
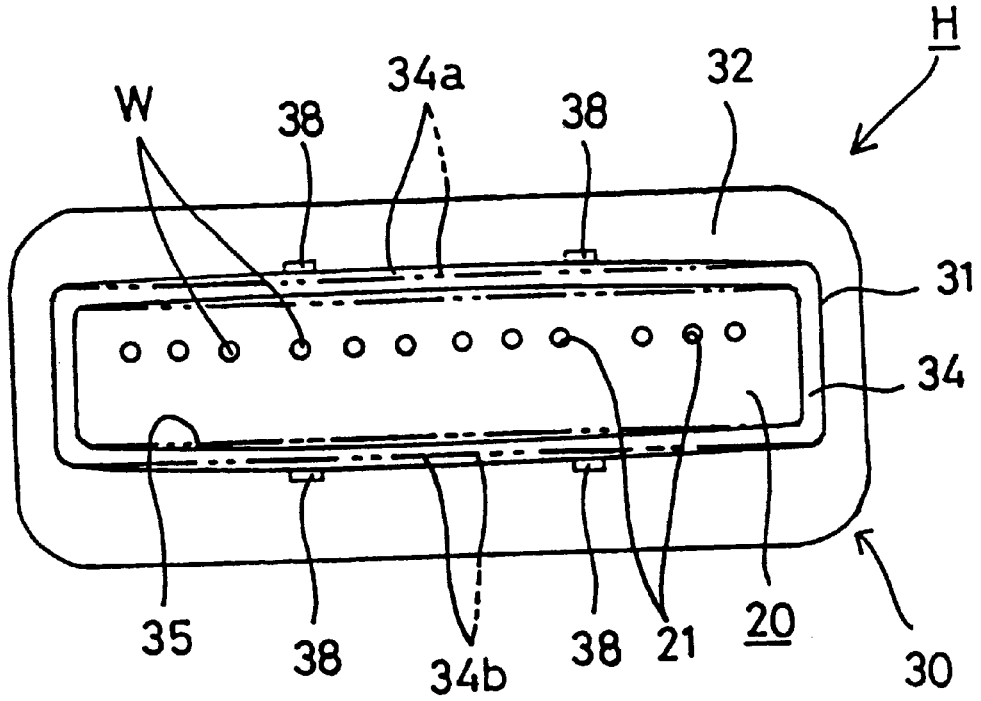
FIG. 5 is a rear elevation showing a condition in which a tubular portion is outwardly deformed by an elastic force of an elastic plug.

The elastic plug 20 mounted in housing area 35 of the tubular portion 34, as shown in FIG. 5, is made water-resistant inside the housing area 35 by tightly contacting the inside surface of the tubular portion 34 in an elastically compressed condition. As shown in FIG. 5, the compressed elastic plug 20 exerts a force on tubular portion 34 sufficient to cause outward deflection of upper wall 34*a* and lower wall 34*b*.

Figure 6:
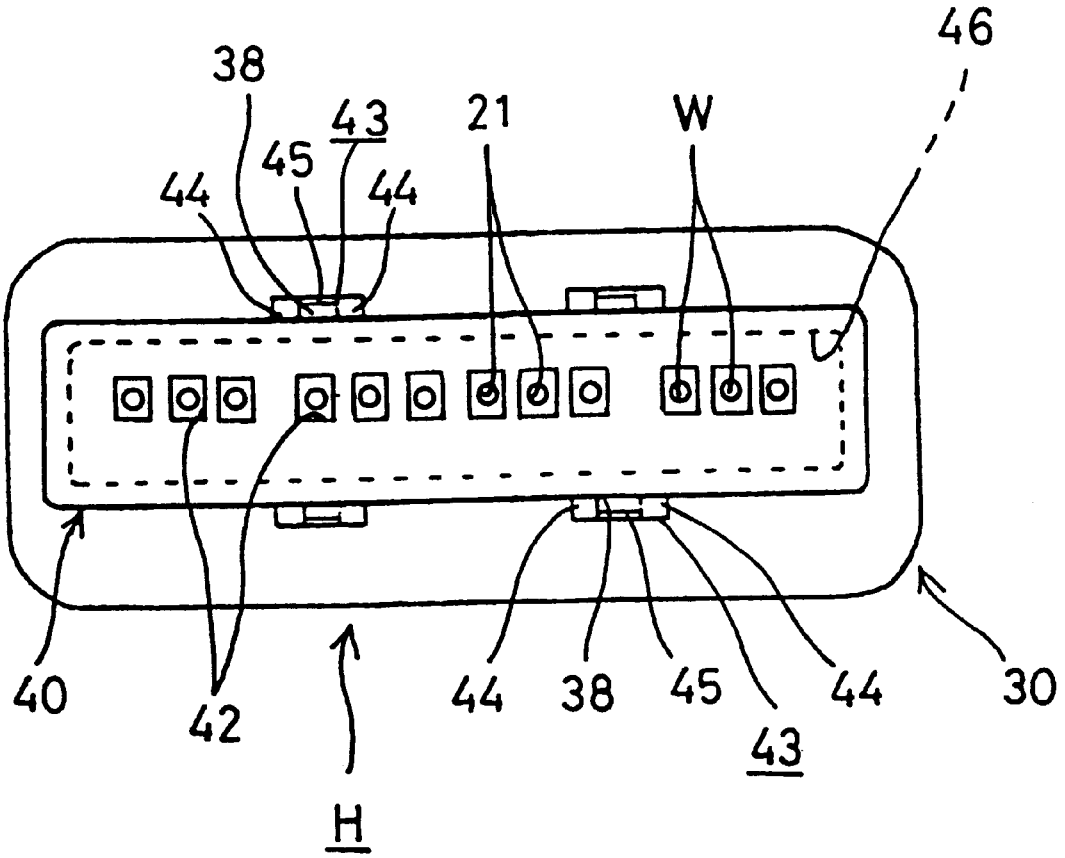
FIG. 6 is a rear elevation showing a condition in which a tubular portion is pressed downwardly by a control piece.

Following this, the pressing member 40 is mounted from the rear of the tubular portion 34. In this case, the pressing member 40 is pressed forward by deflecting each control piece 43 slightly outwardly and at the same time supporting the outer peripheral area of tubular portion 34. Then, the control piece 43 is deformed by passing over the lock tab 38, after which it is elastically returned to its original, undeformed position, as shown in FIGS. 6 and 7. The control pieces 43 make contact with outer peripheral surface of the tubular portion 34 and the lock tabs 38 are engaged with the engagement grooves 45, so that the pressing member 40 is fastened to the tubular portion 34.

In this case, upper wall 34*a* and lower wall 34*b* on the tubular portion 34 are sandwiched between an upper control piece 43 and a lower control piece 43. Therefore, because of the elastic plug 20 being pushed within the area defined by the tubular portion 34 even when the central part causes a condition of outward deformation, the outward deformation of the tubular portion 34 is controlled by a pressing force acting on the tubular portion 34 from the control piece 43, which makes it possible to return the tubular portion to a normal condition. Therefore, returning the elastically deformed condition of the tubular portion 34, due to the elastic plug, to a normal condition can assure a sealability to the tubular portion 34.

Furthermore, along with mounting of the above-mentioned pressing member 40, the inside control member 46 that protrudes forwardly from the main body 41 is press-fit within the inner periphery of the tubular portion 34 with the elastic plug 20 being pressed forwardly. With the inside control area 46 thus positioned, the upper wall 34*a* and lower wall 34*b* of the tubular portion 34 is supported. That is, because the inside control member 46 pushes against the upper wall 34*a* and lower wall 34*b*, inward deformation can be avoided even when a force pressing against the tubular portion 34 tending to collapse the tubular portion is applied from the outside. As explained above, according to the present embodiment, because the tubular portion 34 is pressed on the outer periphery by control pieces 43, outward deformation is prevented, and sealability can be maintained at a favorable level.

In addition, as the inside control area 46 is press-fit in the tubular portion 23, plastic deformation of the tubular portion 34 by a force applied from the outside can be avoided, thereby maintaining uniform sealability in the tubular portion 34. Furthermore, since the control pieces 43 function to maintain downward pressing on the tubular portion 34 in addition to the function of fastening the pressing member 40 onto outer casing 30, the construction of the pressing member 40 can be made simple.

The present invention is not limited to the embodiment as described in the above description and drawings, but also contains the following embodiments as examples in the scope of technology in relation to the present invention. Furthermore, other than the description above, the present invention can be carried out by changing the spirit of the invention within the scope.

(1) In the embodiment described above, a connector housing is separated into an outer casing and an inner casing. However, a connection housing which incorporates both casings is indeed contemplated by the present invention.

(2) In the embodiment as mentioned above, a connector which uses a press-connecting terminal is shown. However, the present invention also allows use of connectors using crimp-style terminals. In such a case, inserting the crimp-style terminal into an insertion hole of the elastic plug mounted into a tubular portion may be acceptable.

(3) In the embodiment as mentioned above, a means which houses one inner casing in an outer casing was shown. However, the present invention also allows use of a so-called, multi-stage type connector to be housed in a plurality of inner casings. Such a multi-stage type connector tends to form a thinner section wall between housing areas for housing an inner casing, thereby causing more useful effects.

(4) In the embodiment as mentioned above, the control piece is equipped with a deformation corrective function of the tubular portion and a lock function for a housing. However, the present invention also contemplates provision of a lock member having a lock function separate from the control piece.

The pressing member for preventing the elastic plug from inadvertent separation is mounted on the rear end surface of the connector housing, and due to the control pieces being pressed against the outer periphery of the tubular portion, the tubular portion is prevented from outward deformation due to elastic force of the elastic plug, thereby enabling favorable sealability of connector housing to be maintained.

Even in the case where a force is applied from outside that may collapse the connector housing, because the periphery of the tubular portion is supported with an inside control area which is press-fit into the inside thereof, plastic deformation of the tubular portion is protected. Thereby, uniformity in sealability of the tubular portion can be maintained.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The present disclosure relates to subject matter contained in priority Japanese Application No. HEI 11-065491, filed on Mar. 11, 1999, which is herein expressly incorporated by reference in its entirety.

What is claimed is:

1. A waterproof connector comprising:

an outer casing comprising a hood area and a tubular portion extending from the hood area, said tubular portion defining a cavity portion, which extends through said tubular portion into the hood area;

an inner casing insertable in said cavity portion, said inner casing comprising at least one cavity configured to receive a metal terminal mounted on an end of a cable;

an elastic plug positioned at an end of said inner casing and insertable into said cavity portion, said elastic plug defining an outer peripheral surface slightly larger than an inner peripheral surface of said cavity, such that said elastic plug exerts an outwardly directed force against the inner peripheral surface of said cavity to enhance sealability between at least said elastic plug and the inner peripheral surface of said cavity and which is sufficient to cause outward deflection of at least a portion of said tubular portion when said elastic plug is inserted into said cavity; and a pressing member mountable on an outer periphery of said tubular portion, said pressing member comprising at least one control piece configured to exert an inwardly directed force against an outer peripheral surface of said tubular portion, in a direction opposite to a direction of the outwardly directed force exerted by said elastic plug;

wherein a waterproof seal between said outer casing and said inner casing is enhanced by the inwardly directed force opposing the outwardly directed force.

2. The waterproof connector of claim 1, said pressing member further comprising an inside control member, said inside control member configured to have a size permitting press-fitting within an inner peripheral surface of said cavity, such that said inside control member exerts an outward force against the inner peripheral surface of said cavity when said pressing member is mounted on the outer periphery of said tubular portion.

* * * * *